US011067358B2

(12) United States Patent
Kim

(10) Patent No.: US 11,067,358 B2
(45) Date of Patent: Jul. 20, 2021

(54) TELESCOPIC CYLINDER ASSEMBLY IN AUTOMATIC RELOADING SYSTEM OF A TOY GUN

(71) Applicant: Keon Hyeong Kim, Suwon-si (KR)

(72) Inventor: Keon Hyeong Kim, Suwon-si (KR)

( * ) Notice: Subject to any disclaimer, the term of this patent is extended or adjusted under 35 U.S.C. 154(b) by 247 days.

(21) Appl. No.: 16/341,060

(22) PCT Filed: Oct. 13, 2017

(86) PCT No.: PCT/KR2017/011280

§ 371 (c)(1),
(2) Date: Apr. 10, 2019

(87) PCT Pub. No.: WO2018/070815

PCT Pub. Date: Apr. 19, 2018

(65) Prior Publication Data

US 2019/0257611 A1 Aug. 22, 2019

(30) Foreign Application Priority Data

Oct. 13, 2016 (KR) ..... 10-2016-0132816

(51) Int. Cl.
*F41B 11/66* (2013.01)
*F41B 11/73* (2013.01)
*F41B 11/89* (2013.01)

(52) U.S. Cl.
CPC ..... *F41B 11/66* (2013.01); *F41B 11/73* (2013.01); *F41B 11/89* (2013.01)

(58) Field of Classification Search
CPC ..... F41B 11/89; F41B 11/66
USPC ..... 42/54; 124/73
See application file for complete search history.

(56) References Cited

U.S. PATENT DOCUMENTS 8,678,877 B2 * 3/2014 Corlett ..... F42B 12/40 446/473

FOREIGN PATENT DOCUMENTS

| | | | |
|---|---|---|---|
| JP | 08233491 A | | 9/1996 |
| JP | 3065816 U | * | 2/2000 |
| JP | 3065816 U | | 2/2000 |

* cited by examiner

*Primary Examiner* — Reginald S Tillman, Jr.
(74) *Attorney, Agent, or Firm* — LEEPI

(57) ABSTRACT

A telescopic cylinder assembly in automatic reloading system of a toy gun is disclosed. It comprises an external cylinder having an internal space formed therein, an internal cylinder located at the internal space of the external cylinder and configured to be movable in longitudinal direction of the external cylinder, a nozzle at least a part thereof is located inside the internal cylinder and configured to be movable in longitudinal direction of the external cylinder, a nozzle supporter connected to the internal cylinder and configured to support the nozzle, and a cylinder valve configured to open and close a front outlet of the nozzle. The internal space of the external cylinder is expanded primarily in accordance with the movement of the internal cylinder, and the internal space is further expanded secondarily in accordance with the movement of the nozzle.

7 Claims, 6 Drawing Sheets

(a)

(b)

(a)

(b)

(a)

(b)

(a)

(b)

(a)

(b)

TELESCOPIC CYLINDER ASSEMBLY IN AUTOMATIC RELOADING SYSTEM OF A TOY GUN

TECHNICAL FIELD

The present invention relates to a cylinder assembly used in an automatic loading system installed in a gas-operated toy gun.

BACKGROUNDS OF ARTS

The mainstream design of a gas-operated toy gun with automatic reloading system using a slide or a bolt carrier is similar to operation of real gun and was originated from early inventions from Western arms and MGC in Japan. The hyper blow back system developed by the MGC was gotten behind in the competition with the magna blow back system by the Western Arms, resulting in MGC going bankrupt. But; MGC's design kept being improved by other manufacturers such as Tanio Koba, KSC, and Tokyo Marui and the majority of present toy guns now adapts hyper blow back system interestingly. The name of the system is differently called such that Hard kick in Tokyo Marui, Pre-shoot in Tanio Koba, and System7 in KSC. The reloading system is mainly configured to 14~15 mm cylinder diameter and 20 mm length. One of the Western Arms system consisted of 30 mm cylinder length but this was only possible by reducing the cylinder diameter smaller than 14 mm. Typically, the system contains only one cylinder inside and the diameter and length of it was determined by the shape of the toy gun.

In the Korean Patent No. 2003-0070418, it discloses the BB bullet supplying system in toy gun, and No. 2003-0132379 explains its reloading system.

SUMMARY OF THE INVENTION

Technical Problems

In case of a gas-operated toy gun, the performance of the automatic reloading device is proportional to the volume of a cylinder assembly. The larger the diameter of the cylinder, the greater the pushing force onto a bolt carrier by the gas pressure, thereby smooth and fast movement of the heavier bolt carrier is achieved. Another important factor for the improvement of performance is the travel length of the cylinder. The length of the cylinder is directly related to bolt carrier's acceleration, so the longer cylinder length, the stronger the recoil shock is generated. In the real firearms, it is virtue to minimize recoil shock, but in toy gun industry, hard recoil shock is considered to be a high quality product and the size of cylinder is very important factor in design of a toy gun.

However, in the existing gas-operated toy gun, only one cylinder is installed and the size of the cylinder is limited by the shape of the gun.

Typically, the maximum traveling distance of the slide in a pistol is in the range of 44 to 50 mm and in a rifle is around 80 mm. In case of gas-operated toy pistol has a cylinder length of 20 to 25 mm, and 40 to 52 mm in a rifle. Therefore, the slide or bolt carrier should travel about 20 to 30 mm distance only through their inertia, overcoming a recoil spring tension.

This is not an issue when the ambient temperature is high and the latent heat required for liquid gas to evaporate is sufficient. But when the ambient air temperature is low or the gas operated toy gun is kept fired and liquid gas in magazine starts to freeze, the traveling distance of the bolt carrier is gradually shortened, eventually causing malfunction.

In particular, the gas-operated toy guns are equipped with a bolt carrier locking mechanism to stop firing action when magazine is empty. The existing automatic loading device for gas operated toy gun sometimes is not capable of pushing the bolt carrier back enough to a locking position, especially in a low temperature and ongoing firing situation.

Assuming the length of the cylinder is increased to overcome the issue, there would be another potential issue that tension of a magazine spring applied to the BB bullet may deviate the nozzle when nozzle is extended due to the leverage effect.

In the case when the nozzle is misaligned at the moment a reloading mechanism is fully extended, the process of retracting the nozzle is interrupted, causing a reloading malfunction. So, a novel idea of how to prevent the issue is required.

The Purpose of the Present Invention

In order to overcome the size limitation of the cylinder in automatic reloading system in a toy gun, the present invention provides an external cylinder and an internal cylinder configured to be in telescopic arrangement so that total length of the cylinder is greatly extended compared to the prior arts.

The internal cylinder is located inside the external cylinder so that the internal cylinder travels in the longitudinal direction of the external cylinder, and a nozzle is located inside the internal cylinder to introduce the gas to an internal space of the external cylinder and reloading the bullet.

When compressed gas goes into an automatic reloading system, a cylinder valve inside the nozzle opens a front outlet of the nozzle to launch a bullet by exhausting a small amount of gas, then the cylinder valve closes the front outlet of the nozzle instantaneously. Compressed gas is then rerouted to the internal space of the external cylinder. The pressure generated by the gas pushes the internal cylinder, then the internal cylinder with the nozzle starts a primary movement along the longitudinal direction of the external cylinder. The internal cylinder travels up to the position that the sealing of the gas is maintained. The pressure generated by gas sufficiently supplied into the inner space now pushes the nozzle inside the internal cylinder. The nozzle starts a secondary movement in the longitudinal direction of the external cylinder. At this moment, a nozzle supporter places the nozzle in position during extension from the internal cylinder.

In other words, the nozzle tends to be misaligned due to the pushing force from the bottom by a magazine spring. The nozzle supporter prevents such error by supporting the top side of the nozzle.

In a state that the internal space is expanded in maximum, supply of gas may be shut off. Then, the restoring force generated by a first recoil spring and will bring back the nozzle and the internal cylinder in original position, and the restoring force generated by a second recoil spring move the cylinder valve in position so that the automatic reloading system is ready to reload for the next bullet and shooting.

For this purpose, as an embodiment of a telescopic cylinder assembly in automatic reloading system of a toy gun, the present invention comprises an external cylinder having an internal space formed therein, an internal cylinder located at the internal space of the external cylinder and configured to be movable in longitudinal direction of the external cylinder, a nozzle at least a part thereof is located inside the internal cylinder and configured to be movable in longitudinal direction of the external cylinder, a nozzle supporter connected to the internal cylinder and configured to support the nozzle, and a cylinder valve configured to open and close a front outlet of the nozzle. The internal space of the external cylinder is expanded primarily in accordance with the movement of the internal cylinder, and the internal space is further expanded secondarily in accordance with the movement of the nozzle.

As an embodiment of the telescopic cylinder assembly, the nozzle supporter further comprises a supporting body formed as a hollow semi cylinder and configured to support around an outer side of the nozzle, and an enclosure inserted and assembled into a protrusion formed at the internal cylinder.

As an embodiment of the telescopic cylinder assembly, a telescopic cylinder assembly further comprises a first guide slot formed at both sides and in longitudinal direction of the external cylinder. The protrusion of the internal cylinder is inserted to the first guide slot and configured to only move along the first guide slot.

As an embodiment of the telescopic cylinder assembly, it may further comprise a first recoil spring with one end thereof connected to the external cylinder and the other end thereof connected to the nozzle. The first recoil spring provides restoring force to the nozzle back in original position.

As an embodiment of the telescopic cylinder assembly it may further comprise a second recoil spring with one end thereof connected to the nozzle and the other end thereof connected to the cylinder valve. The second recoil spring provides restoring force to the cylinder valve.

As an embodiment of the telescopic cylinder assembly, it may further comprise a gas flow hole formed at one end of the internal cylinder. The gas flow hole is configured so that gas introduced from a gas inlet at the nozzle goes into the internal space of the external cylinder.

Effects of the Invention

The primary movement is driven by the internal cylinder with a strong traction force but the maximum travel speed is low. And the secondary movement is effectively achieved by the nozzle having a comparatively low traction force but a high speed by acceleration. This would be a similar effect that an automobile is driven from the first gear to the second gear shifting for acceleration.

Finally, the telescopic cylinder assembly according to the present invention has a cylinder length of 1.5 times or more compared to the conventional automatic reloading system. So, the acceleration is increased about 1.5 times or more accordingly and deceleration is reduced to half or less, generating more powerful reaction force onto the toy gun. Also, the ability to propel the bolt carrier to move a desired traveling distance is achieved even in cold weather or sustained firing situations In addition, as described above, a problem that the nozzle may be misaligned by the magazine spring is resolved by separately providing the nozzle supporter.

DETAILED DESCRIPTION OF THE BEST MODE

Figure 1:
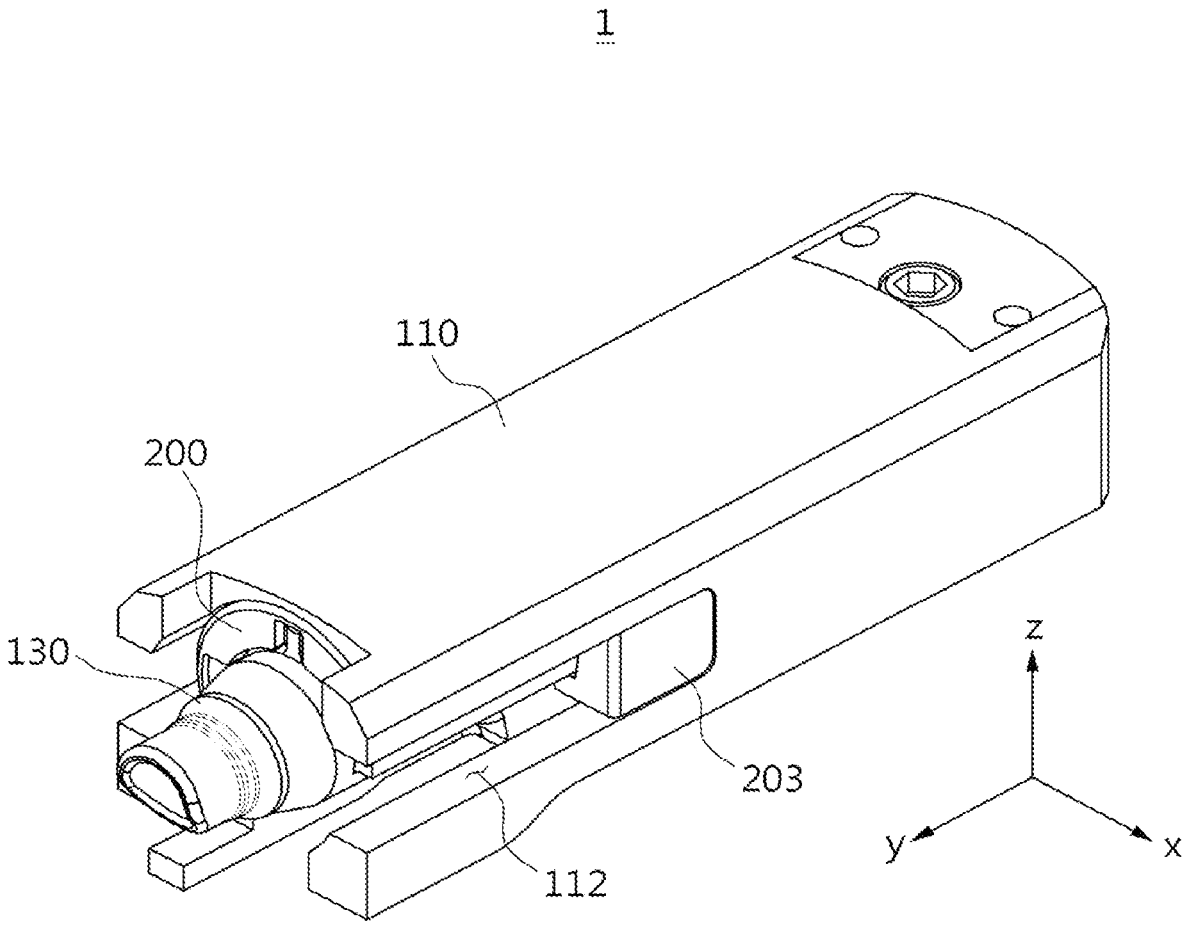
FIG. 1 is a perspective view of a telescopic cylinder assembly 1.

Hereinafter, embodiments will be described in detail with reference to exemplary drawings. It should be noted that, in adding reference numerals to the constituent elements of the drawings, the same constituent elements are denoted by the same reference numerals even though they are shown in different drawings. In the following description of the embodiments, detailed description of known functions and configurations incorporated herein will be omitted when it may make the best of an understanding clear.

In describing the components of the embodiment, terms such as first, second, A, B, (a), and (b) may be used. These terms are intended to distinguish the constituent elements from other constituent elements, and the terms do not limit the nature, order or order of the constituent elements. When a component is described as being "connected", "coupled,", or "connected" to another component, the component may be directly connected or connected to the other component.

Figure 2:
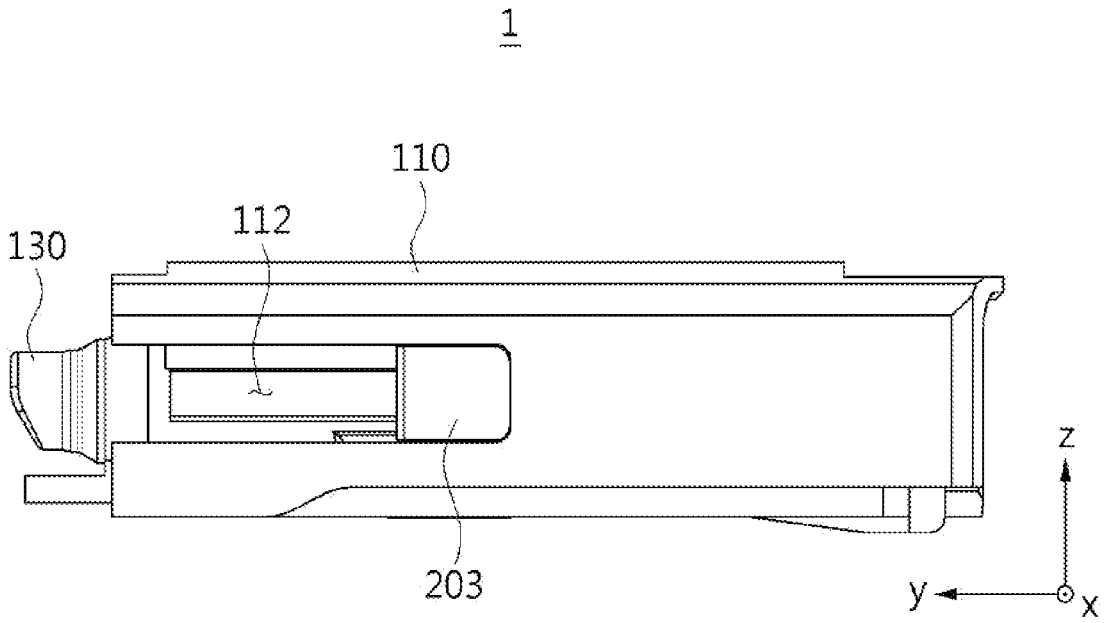
FIG. 2(*a*) a side view of the telescopic cylinder assembly 1, and FIG. 2(*b*) is a cross sectional side view thereof.
Figure 2:
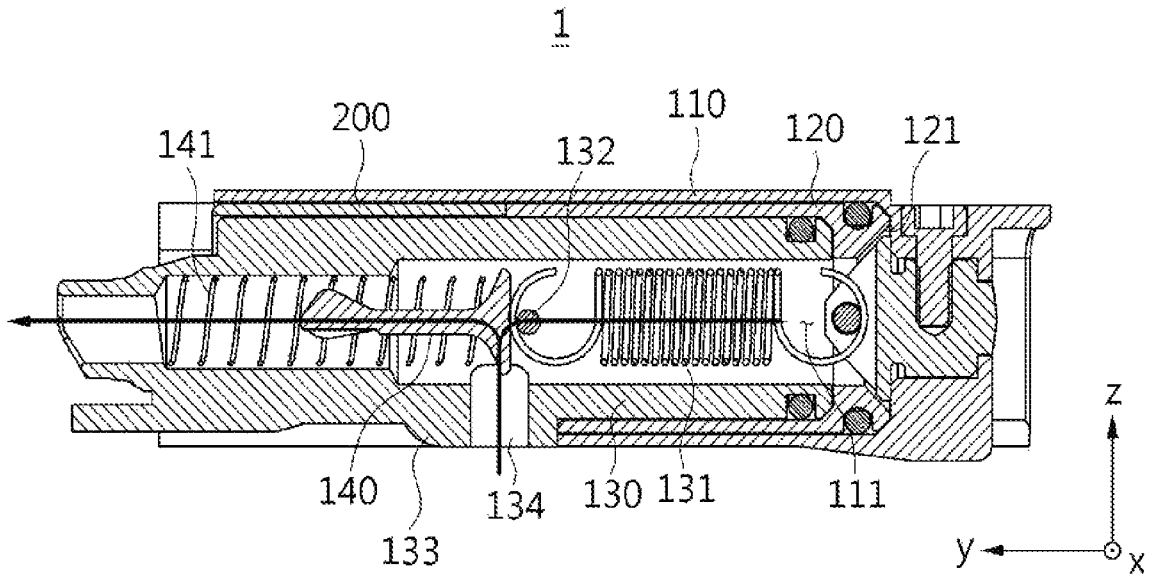

FIG. 1 is a perspective view of a telescopic cylinder assembly 1 according to an embodiment of the present invention, and FIG. 2(*a*) is a side view of the telescopic cylinder assembly 1, and FIG. 2(*b*) is a cross-sectional side view thereof.

As shown in the FIG. 1 and FIG. 2, the cylinder assembly 1 includes an external cylinder 110, an internal cylinder 120 located inside of the external cylinder 110 and can be extended and retracted in longitudinal direction of the external cylinder 110, a nozzle 130 located inside of the internal cylinder 120 and can be extended and retracted in longitudinal direction of the external cylinder 110, and a nozzle supporter 200 configured to support the nozzle 130.

An internal space 111 is formed inside the external cylinder 110 and the size of the internal space 111 is primarily expanded as the internal cylinder 120 moves to extended. The inner space 111 can be expanded secondarily as the nozzle 130 moves to extend. Hereinafter, this will be described in detail.

The telescopic cylinder assembly 1 may be used for a top gun such as a BB bullet gun. The telescopic cylinder assembly 1 is used for launching BB bullet by using gas pressure and exhaustion, so the external cylinder 110 may include the internal space 111 to house the gas.

The internal cylinder 120 is located inside the external cylinder 110. One side of the internal cylinder 120 is open with a gas flow hole and the internal cylinder 120 can move in the longitudinal direction of the external cylinder 110.

At least part of the nozzle 130 may be located inside the internal cylinder 120. Both sides of the nozzle unit 130 are open with holes and the nozzle 130 can move in the longitudinal direction of the external cylinder 110.

Thus, the external cylinder 110, the internal cylinder 120, and the nozzle 130 in are placed in a superposed manner; the nozzle 130 is housed by the internal cylinder 120 and the internal cylinder 120 is housed by the external cylinder 110 respectively. The telescopic cylinder assembly 1 further includes a first recoil spring 131 and a second recoil spring 141, which provide corresponding parts with restoring forces.

More specifically, the first recoil spring 131 may provide the internal cylinder 120 and the nozzle 130 with restoring force. One end of the first recoil spring 131 may be fixed to the external cylinder 110 and the other end may be connected to the nozzle 130. For example, the other end of the first recoil spring 131 may be attached by a pin 132 installed across the longitudinal direction of the nozzle 130. When the gas is infused to the internal space 111, the pressure originated by the gas will push the internal cylinder 120 and the nozzle 130 to move, then overall length of the cylinder assembly 1 will be increased. At this moment, the first recoil spring 131 is also extended. When gas removed from the internal space 111, the internal cylinder 120 and the nozzle 130 come back to original position by restoring force of the first recoil spring 131.

The telescopic cylinder assembly 1 may include a cylinder valve 140 configured to open and close a front outlet of the nozzle 130. At this time, a portion of the cylinder valve 140 is smaller than inner diameter of the nozzle 130 so that the cylinder valve 140 is inserted into the nozzle 130.

The second recoil spring 141 can provide the cylinder valve 140 with restoring force. The second recoil spring 141 may be connected to the nozzle 130 at one end and cylinder valve 140 to the other end. When the gas is infused to the internal space 111, the pressure originated by the gas will push the cylinder valve 140 and the front outlet of the nozzle 130 is closed by the cylinder valve 140. At this moment, the second recoil spring 141 is also compressed. When gas is removed from the internal space 111, the cylinder valve 141 is pushed back to original position by restoring force of the second recoil spring 141 and the front outlet of the nozzle 130 gets open.

Figure 3:
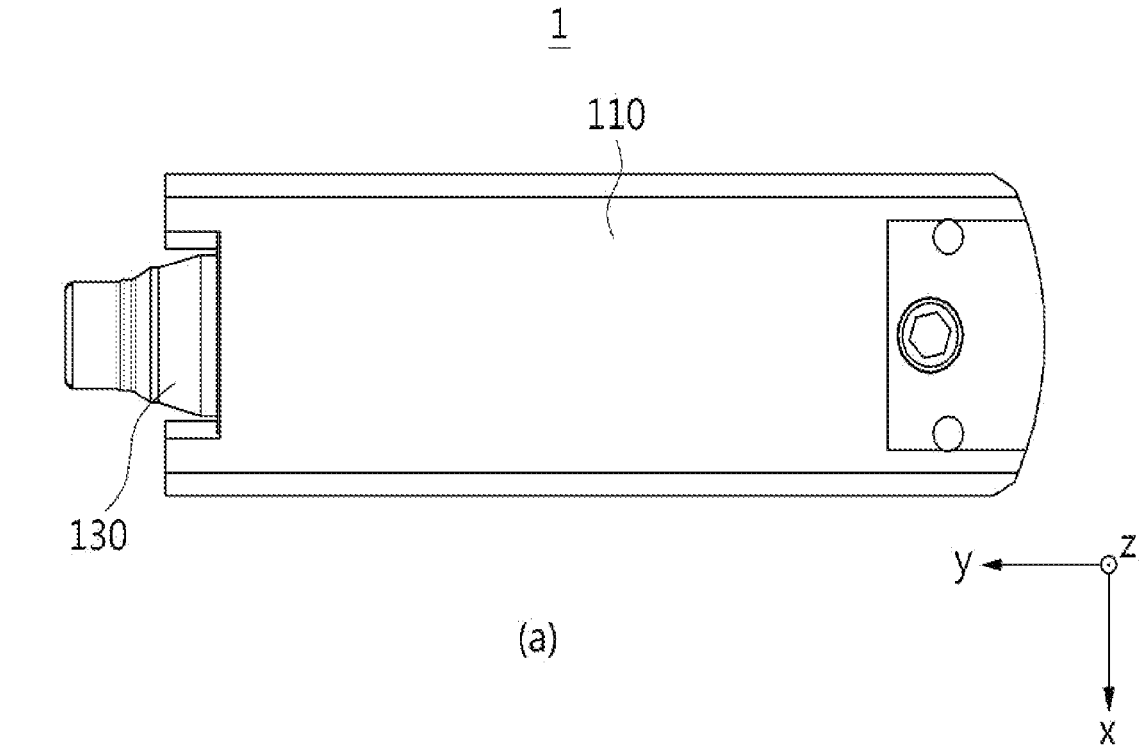
FIG. 3(*a*) is a top view of the telescopic cylinder assembly 1, and FIG. 3(*b*) is a cross-sectional view thereof.
Figure 3:
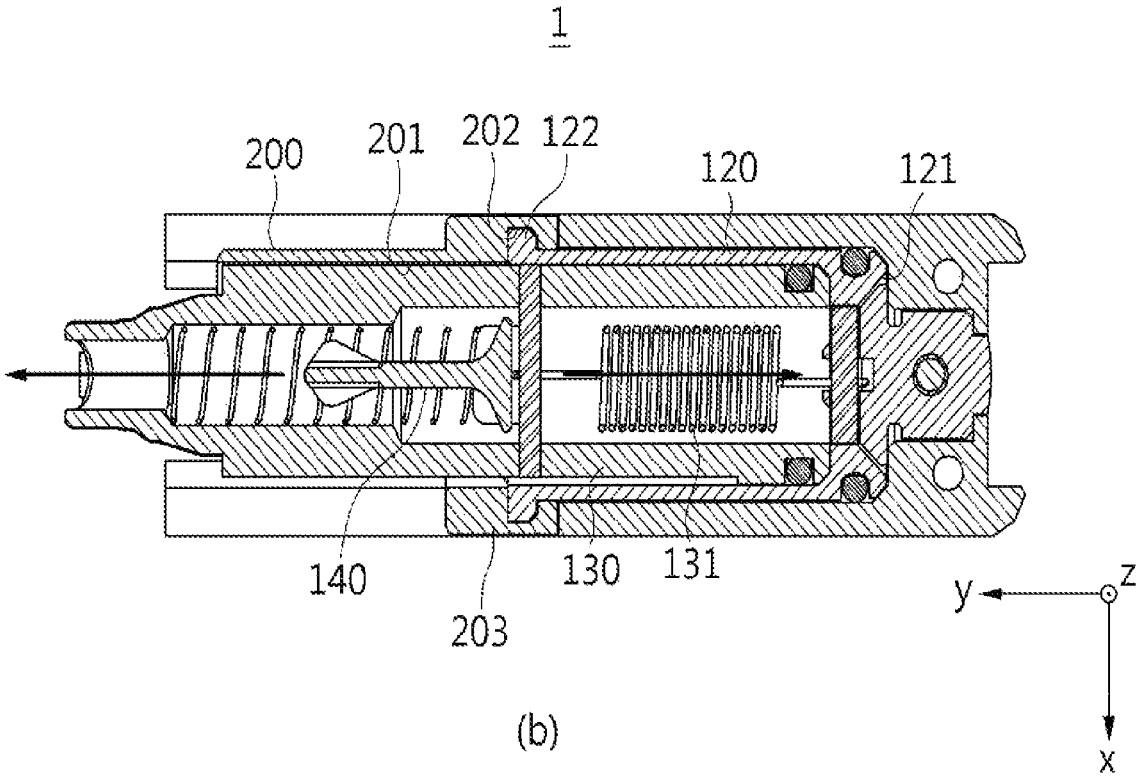

FIG. 3(*a*) is a top view of the telescopic cylinder assembly 1, and FIG. 3(*b*) is a cross-sectional view thereof.

A nozzle supporter 200 is formed as a supporting body 201 shaped as a hollow semi-cylinder type to surround and support a top portion of the nozzle 130. The nozzle supporter 200 further comprises with a 'C' shaped enclosure 202, 203 configured to at one end thereof to hold an extrusion 122 formed at outer side of the internal cylinder 120.

Although the enclosure 202, 203 of the nozzle supporter 200 is disclosed in this embodiment, the present invention is not limited thereto. In particular, it can be used as a coupling, a coupling by a fastening mechanism such as a screw or a pin, and any physical/chemical connection method.

The extrusion 122 formed at outer side of the internal cylinder 120 is guided by a first guide slot 112 formed at both sides of the external cylinder 110. The extrusion 122 limits the traveling distance of the internal cylinder 120 so that the inner space 111 kept being sealed. At this moment, the nozzle supporter 200 supports around the nozzle 130 simultaneously to prevent misalignment due to the pushing force by a magazine spring, which will be explained in detail later.

Figure 4:
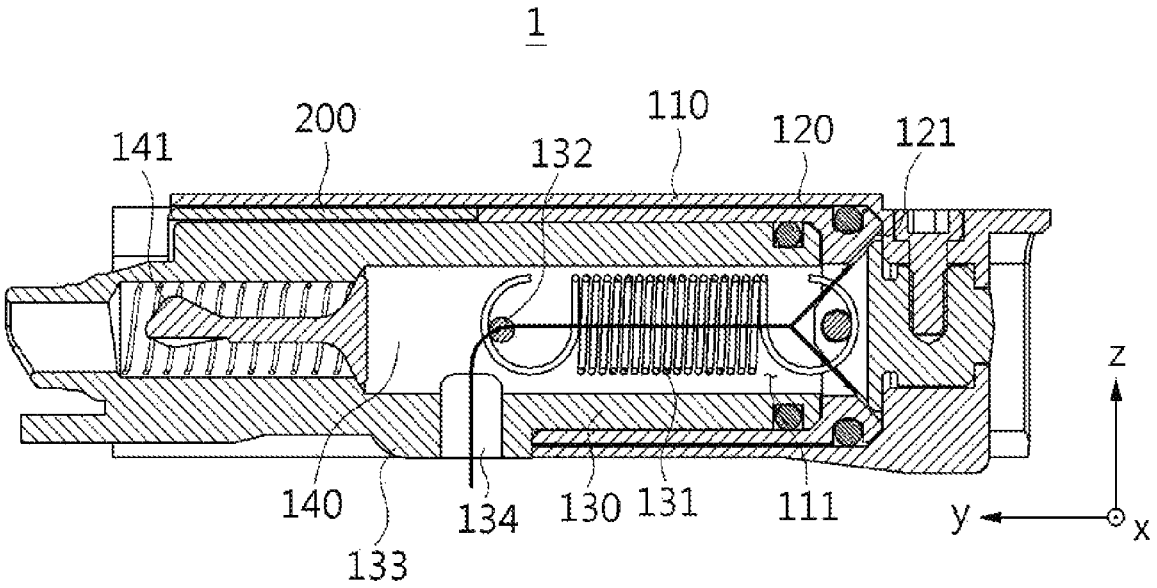
FIG. 4(*a*) is a side cross-sectional view of the telescopic cylinder assembly 1 at an initial state that an internal cylinder 120 and a nozzle 130 are positioned inside an external cylinder 110, and FIG. 4(*b*) is a top cross-sectional view thereof.
Figure 4:
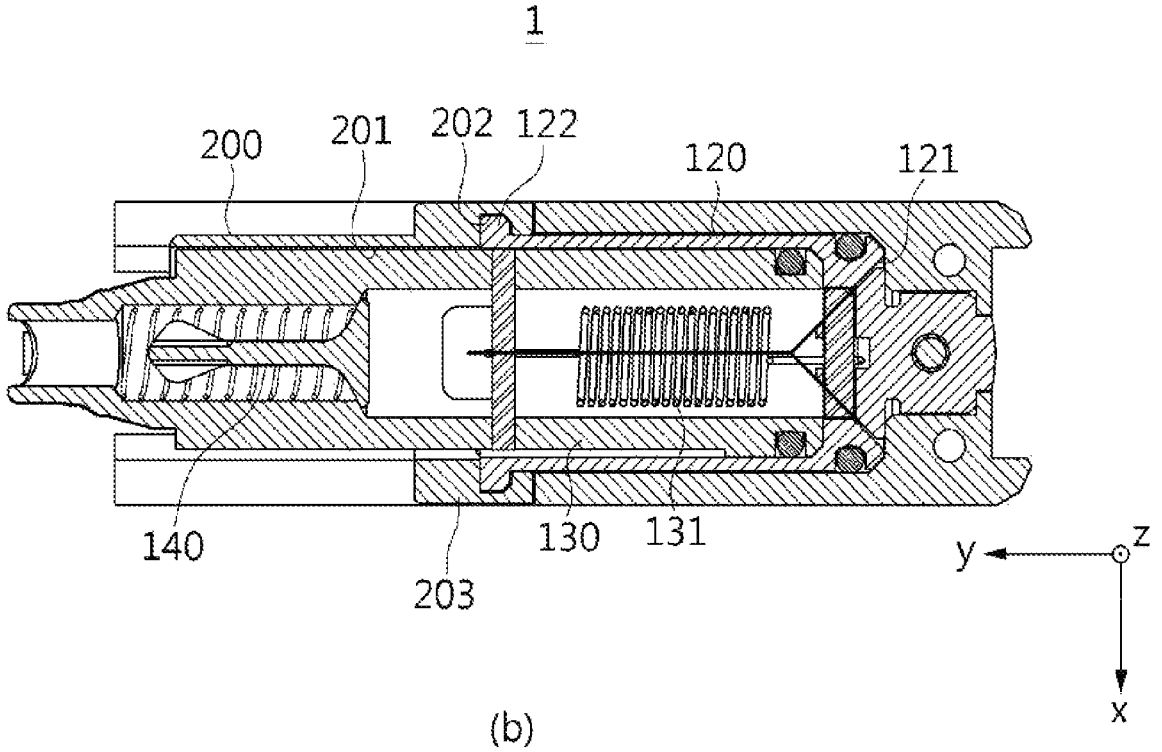

Based on the present invention, the primary extension by the internal cylinder 120 and the secondary extension by the nozzle 130 is disclosed hereafter. FIG. 4(*a*) is a side cross-sectional view of the telescopic cylinder assembly 1 at the initial state that an internal cylinder 120 and the nozzle 130 are positioned inside the external cylinder 110, and FIG. 4(*b*) is a top cross-sectional view thereof. The cylinder valve 140 may be open or closed at this moment. The arrow indicates that the gas flows into the internal space 111 of the external cylinder 110.

Figure 5:
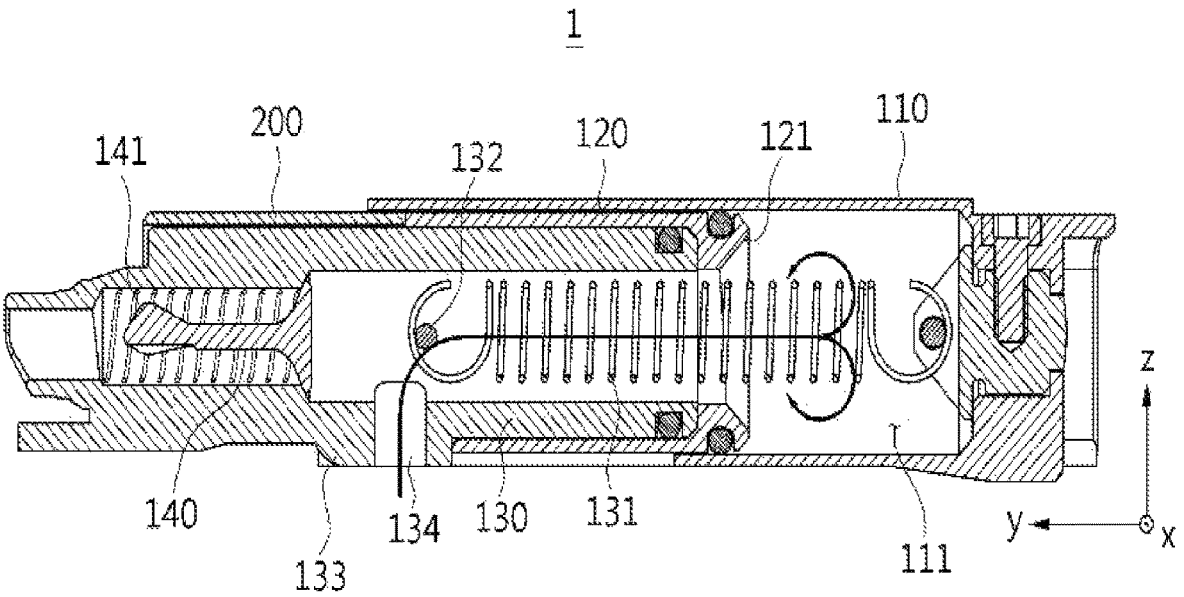
FIG. 5(*a*) is side cross-sectional view of the telescopic cylinder assembly 1 at first extended state that the internal cylinder 120 is extended along the external cylinder 110, and FIG. 5(*b*) is a top cross-sectional view thereof.
Figure 5:
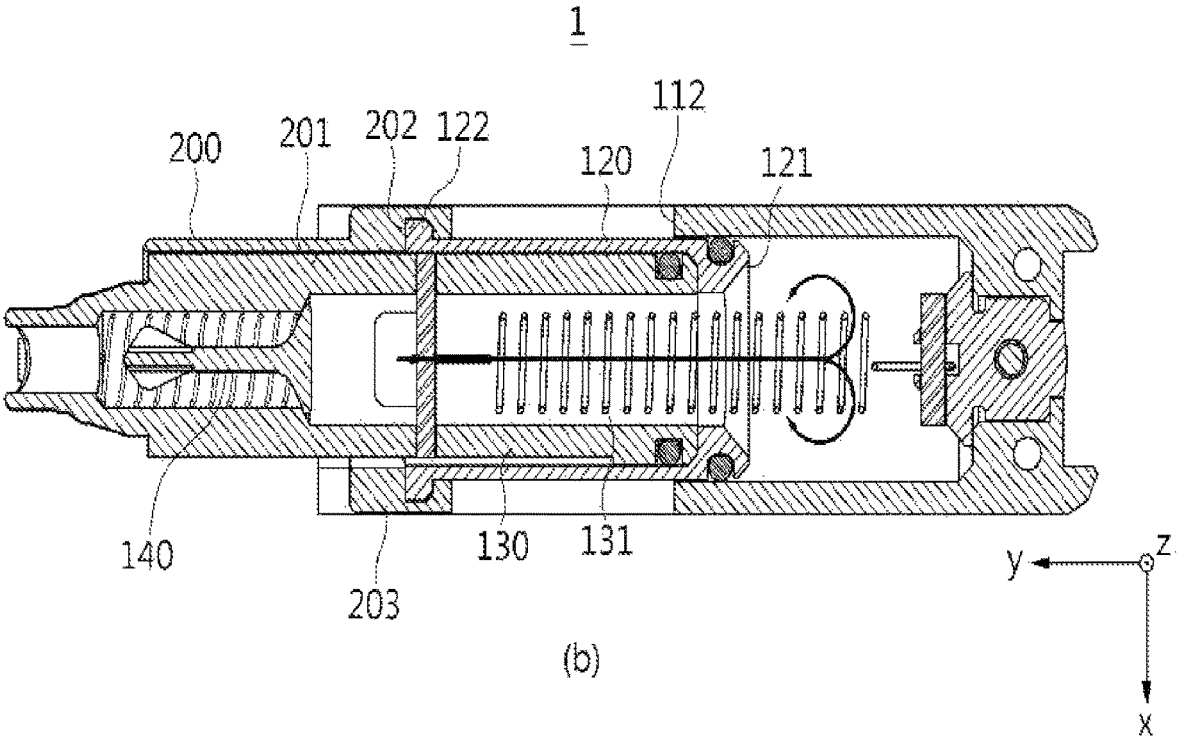

FIG. 5(*a*) is a side cross-sectional view of the telescopic cylinder assembly 1 at primary extension state that the internal cylinder 120 is extended along the external cylinder 110, and FIG. 5(*b*) is a top cross-sectional view thereof.

In FIGS. 5(*a*) and (*b*), when the gas goes into the internal space 111 through a gas inlet 134, the pressure generated by the gas pushes the cylinder valve 140, then the front outlet of the nozzle 130 is closed.

The internal cylinder 120 is configured to have a gas flow hole 121 at one end so that the gas coming through the gas inlet 134 passes through the nozzle 130 and the internal cylinder 120, reaching to the inner space 111 of the external cylinder 110. The pressure generated by the gas now pushes the internal cylinder 120, then the internal cylinder 120 starts moving positive Y direction based on the coordinate shown in FIG. 5.

The internal cylinder 120 is configured to move in the longitudinal direction of the external cylinder 110. The in space 111 may increase in volume, as the internal cylinder 120 moves to extend.

A frictional member (not shown) may be provided on the surface of the nozzle 130 to provide a friction between the nozzle 130 and the internal cylinder 120. Then, the nozzle 130 the internal cylinder 120 may move like one body thanks to the friction at the time of the primary extension of the telescopic cylinder assembly 1.

The movement of the internal cylinder 120 may be controlled by the protrusion 122 that moves along the first guide slot 112. The first guide slot 112 may have a length up to that the internal cylinder 120 maintains sealing of the inner space 111.

Figure 6:
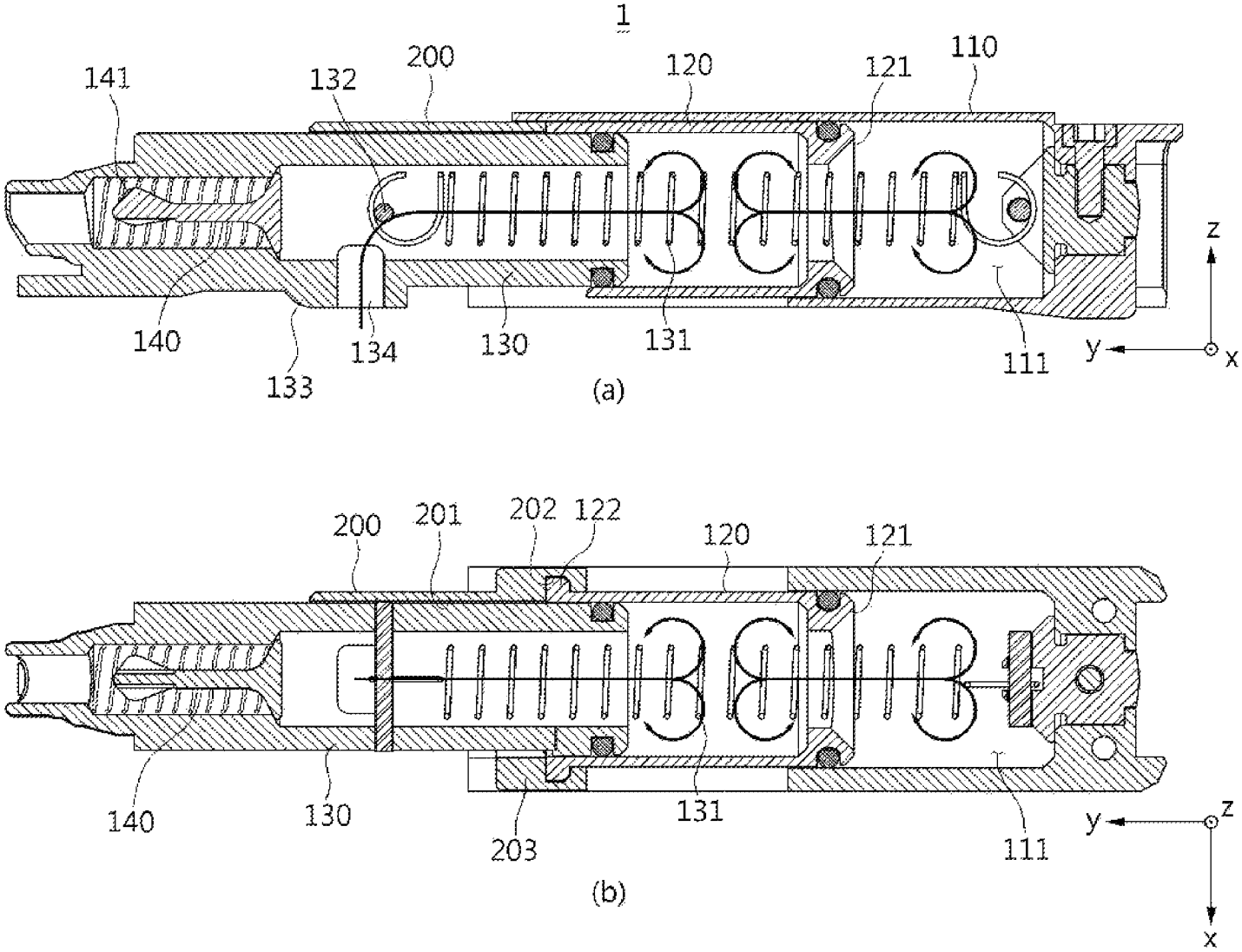
FIG. 6(*a*) is a side cross-sectional view of the telescopic cylinder assembly 1 at second extended state that the nozzle 130 is extended along the internal cylinder 120, and FIG. 6(*b*)*is* a top cross-sectional view thereof.

FIG. 6(*a*) is a side cross-sectional view of the telescopic cylinder assembly a at secondary extension state that the nozzle 130 is extended along the internal cylinder 120, and FIG. 6(*b*) is a top cross-sectional view thereof.

Referring to FIGS. 6(*a*) and (*b*), the pressure generated by the gas sufficiently supplied into the inner space 111 will now pushes the nozzle 130. The nozzle 130 moves in the longitudinal direction of the external cylinder 110 and the internal space 111 will increase further in volume.

At this moment, the nozzle supporter 200 supports the nozzle 130 extended from the internal cylinder 120. In other words, the nozzle 130 tends to be misaligned due to the pushing force from the bottom by a magazine spring (not shown) and the nozzle support 200 prevents such error by supporting the top side of the nozzle 130.

In a state that the internal space 111 is expanded in maximum, the gas supply may be shut off. When the supply of the gas is ceased, restoring force generated by a first recoil spring 131 and a second recoil spring 141 will bring back the nozzle 130 and the internal cylinder 120 in original position shown in FIGS. 2(*a*) and (*b*).

While the present invention has been particularly shown and described with reference to exemplary embodiment thereof, it is to be understood that the invention is not limited to the disclosed exemplary embodiment. For example, it is to be understood that the techniques described may be performed in a different order than the described methods, and/or that components of the described systems, structures, devices, circuits, equivalents, even if it is replaced or replaced.

Therefore, other implementations, other embodiments and equivalents to the claims are within the range of the following claims.

I claim:

1. A telescopic cylinder assembly in automatic reloading system of a toy gun comprising:

an external cylinder having an internal space formed therein;

an internal cylinder located at the internal space of the external cylinder and configured to be movable in longitudinal direction of the external cylinder;

a nozzle at least a part of which is located inside the internal cylinder and configured to be movable in longitudinal direction of the external cylinder and both sides of which are open with a gas inlet;

a nozzle supporter connected to the internal cylinder and configured to support the nozzle; and a cylinder valve configured to open and close the nozzle;

wherein the internal space of the external cylinder is expanded primarily in accordance with the movement of the internal cylinder, and the internal space is further expanded secondarily in accordance with the movement of the nozzle.

2. A telescopic cylinder assembly of claim 1, the nozzle supporter further comprises:

a supporting body formed as a hollow semi cylinder and configured to support around an outer side of the nozzle; and, an enclosure inserted and assembled into a protrusion formed at the internal cylinder.

3. A telescopic cylinder assembly of claim 1, further comprises:

a first guide slot formed at both sides and in longitudinal direction of the external cylinder; and, wherein the protrusion of the internal cylinder is inserted to the first guide slot and configured to only move along the first guide slot.

4. A telescopic cylinder assembly of claim 1, further comprises:

a first recoil spring with one end thereof connected to the external cylinder and the other end thereof connected to the nozzle; wherein the first recoil spring provides restoring force to the nozzle back in original position.

5. A telescopic cylinder assembly of claim 4, wherein the first recoil spring is connected to the nozzle with a pin installed across the longitudinal direction of the nozzle.

6. A telescopic cylinder assembly of claim 1, further comprises:

a second recoil spring with one end thereof connected to the nozzle and the other end thereof connected to the cylinder valve; wherein the second recoil spring provides restoring force to the cylinder valve.

7. A telescopic cylinder assembly of claim 1, further comprises:

a gas flow hole formed at one end of the internal cylinder;

wherein the gas flow hole is configured so that gas introduced from a gas inlet at the nozzle goes into the internal space of the external cylinder.

* * * * *